US006807728B2

(12) United States Patent
Griffin et al.

(10) Patent No.: US 6,807,728 B2
(45) Date of Patent: Oct. 26, 2004

(54) CRIMP FOR A JACK

(76) Inventors: Michelle Griffin, 2516 Powell Dr., Gatesville, TX (US) 76528; Steve Rohrbach, 721 N. First, Suite A, Mt. Vernon, WA (US) 98273

( * ) Notice: Subject to any disclaimer, the term of this patent is extended or adjusted under 35 U.S.C. 154(b) by 195 days.

(21) Appl. No.: 10/078,810

(22) Filed: Feb. 19, 2002

(65) Prior Publication Data

US 2003/0145457 A1 Aug. 7, 2003

Related U.S. Application Data

(60) Provisional application No. 60/270,185, filed on Feb. 20, 2001, provisional application No. 60/339,198, filed on Dec. 7, 2001, and provisional application No. 60/340,518, filed on Dec. 11, 2001.

(51) Int. Cl.[7] ..... H01R 43/042

(52) U.S. Cl. ..... 29/751; 29/750; 29/753; 29/758; 29/566.4; 29/33 M; 29/749; 7/107; 72/409.14

(58) Field of Search ..... 29/751, 758, 753, 29/749, 566.4, 33 M, 747, 748, 750, 566.3; 72/409.14, 416; 81/421, 426.5; 7/107

(56) References Cited

U.S. PATENT DOCUMENTS

| | | | | |
|---|---|---|---|---|
| 4,174,560 A | | 11/1979 | Senior et al. | |
| 4,227,299 A | | 10/1980 | Kuehling | |
| 4,386,461 A | | 6/1983 | Plummer | |
| 4,429,451 A | | 2/1984 | Angelico | |
| 4,557,034 A | | 12/1985 | Pfundt | |
| 4,625,386 A | * | 12/1986 | Bieganski | 29/566.4 |
| 4,862,580 A | * | 9/1989 | Wang et al. | 29/566.4 |
| 4,934,204 A | * | 6/1990 | Hadden, Sr. | 74/107 |
| 4,981,032 A | | 1/1991 | Chen | |
| 5,109,591 A | * | 5/1992 | Hung | 29/566.4 |
| 5,187,968 A | | 2/1993 | Beetz et al. | |
| 5,214,842 A | | 6/1993 | Chen | |
| 5,402,561 A | | 4/1995 | Cerquone et al. | |
| 5,832,603 A | | 11/1998 | Fallandy | |
| 5,992,002 A | | 11/1999 | Hung | |
| 2003/0145457 A1 | * | 8/2003 | Griffin et al. | 29/758 |

* cited by examiner

*Primary Examiner*—Minh Trinh
(74) *Attorney, Agent, or Firm*—Bracewell & Patterson, L.L.P.

(57) ABSTRACT

A crimping tool has a handle lever portion and a crimp portion with a press and a base housing. The base housing has a placement location with a recessed surface for engaging a jack and a recessed region for a cable. The base housing also has lateral regions that have frictionally engaging surface portions for clamping to wire ends. The press has a plunger and a housing with terminating blades for shearing excess wire from the cable when the tool engages a twisted pair cable to a jack. The blades cut the wires and the excess wire is discarded. The press and the base housing then disengage and the jack is removed from the tool with the cable in communication with the electrical contacts of the jack.

13 Claims, 17 Drawing Sheets

CRIMP FOR A JACK

This patent application is based upon and claims priority with respect to the following three Provisional Patent Applications: No. 60/270,185, filed Feb. 20, 2001; No. 60/339,198, filed Dec. 7, 2001; and No. 60/340,518, filed Dec. 11, 2001.

BACKGROUND OF THE INVENTION

1. Field of the Invention

The present invention relates generally to the crimping process network jacks, and more particularly to an improved crimping tool for terminating telecommunications cable conductors in an appropriate receptacle.

2. Description of the Prior Art

In installing computer networks, such as Category 5 cable with RJ45 jacks, a jack is installed at the end of the cable. To install a jack, four sets of twisted wire are unwound and placed on specific receiving portions of the jack. These receiving portions comprise sharp scissors-like means which cut the insulation of each wire and allows electrical communication between the jack and the wire.

In the prior art, each wire in a multi-wire cable is typically individually punched into a receiving means with a single wire punch tool. When a wire is punched, the outward portion of the wire is cut off by a sharp portion of the punch tool. There are various drawbacks to using a single wire punch tool. Such punch tools can only terminate one wire at a time and are thus inefficient and time-consuming. There is also a possibility that the punched tool will be disoriented by the user relative to the wire and accidentally cut the wire on the inward side of the jack.

There has been at least one attempt to terminate more than one wire in a jack in a single step. U.S. Pat. No. 5,832,603, discloses a hand-held, manually-operated termination tool for terminating all of the wires of a cable at the same time. Although this design is workable, it has a significant number of limitations. An improved termination tool, such as the present invention, which accomplishes the same task more effectively would be highly desirable.

SUMMARY OF THE INVENTION

One embodiment of a crimping tool has a handle lever portion and a crimp portion with a press and a base housing. The base housing has a placement location with a recessed surface for engaging a jack and a recessed region for a cable. The base housing also has lateral regions that have frictionally engaging surface portions for clamping to wire ends. The press has a plunger and a housing with terminating blades for shearing excess wire from the cable when the tool engages a twisted pair cable to a jack.

During the crimping process, a jack is positioned in the base housing and the cable has four twisted pair sets of wires. The wires extend into receiving slots of the jack. After the jack is properly positioned, the terminating process begins when the handle lever portion is operated and the housing engages the base housing to temporarily hold the wires. After the housings engage, the plunger extends through the housing and the blades compress the wires down within the receiving slots of the jack. Further, the blades cut the wires and the excess wire is discarded. The press and the base housing then disengage and the jack is removed from the tool with the cable in communication with the electrical contacts of the jack.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF PREFERRED EMBODIMENT OF THE PRESENT INVENTION

Figure 1:
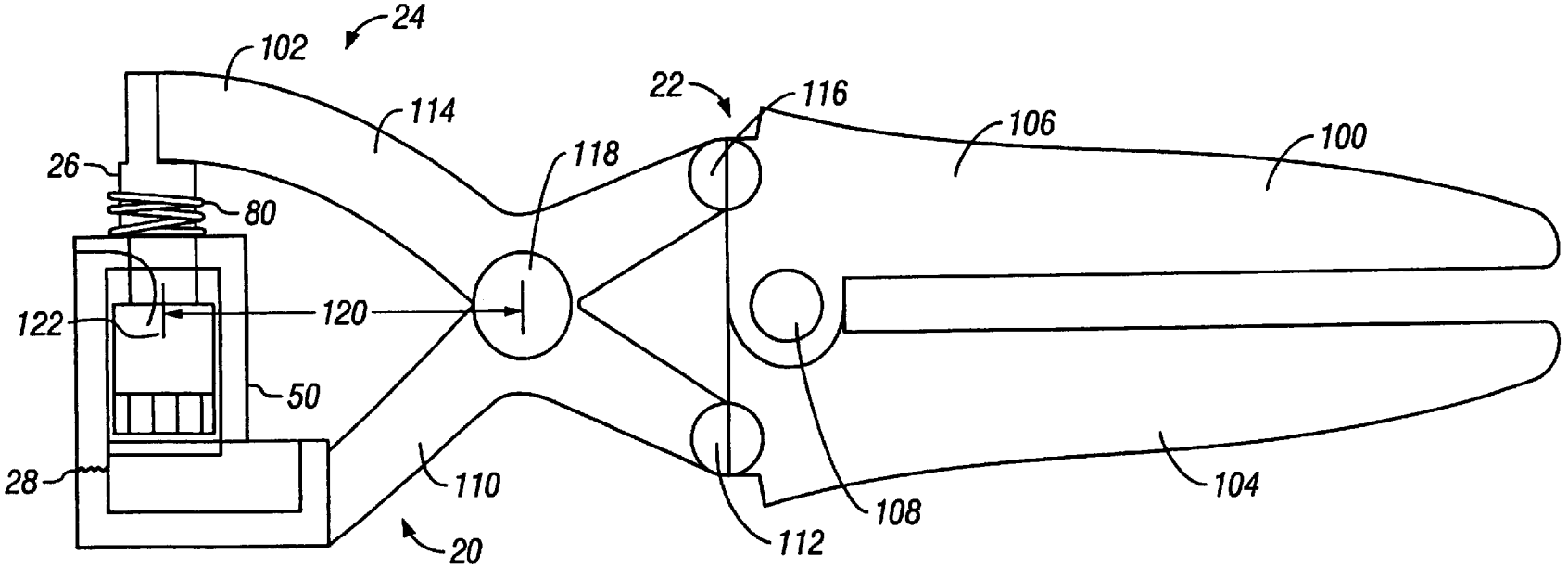
FIG. 1 is a side view of the tool.
Figure 2:
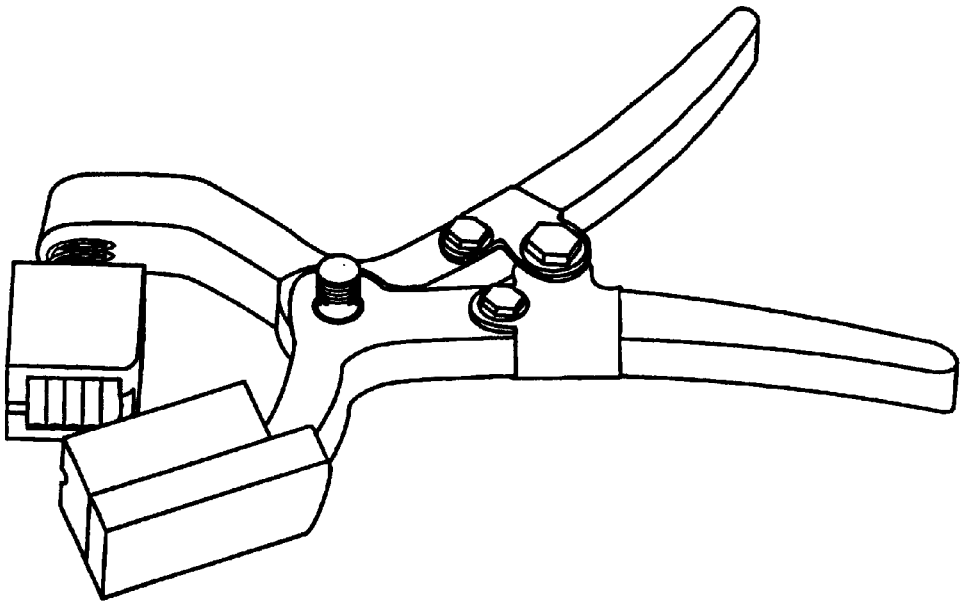
FIG. 2 is an isometric view of the tool.

Referring now to FIGS. 1 and 2, apparatus 20 comprises a handle lever portion 22 and a crimp portion 24. The crimp portion 24 comprises a press 26 and a base housing 28. As shown in FIGS. 4, 5, 13, 16, 19, and 22, the base housing 28 comprises a placement location 30 that has a recessed surface 32 that is adapted to engage the outer surface of a jack. Located in the forward region of the base housing 28, is a recessed region 34 adapted to allow cable to pass therethrough. The base housing 28 further comprises lateral regions 36 that have a frictionally engaging surface portions 38 thereon that are adapted to clamp to wire ends which will be discussed further herein later in this text. The base housing 28 further has a base surface 40 (FIGS. 5*a* and 5*c*) that is adapted to support a jack housing therein during the clamping process.

Figure 3:
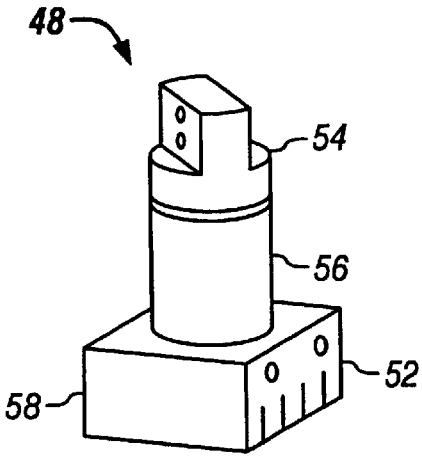
FIG. 3 is an isometric view of a plunger element of the press.
Figure 4:
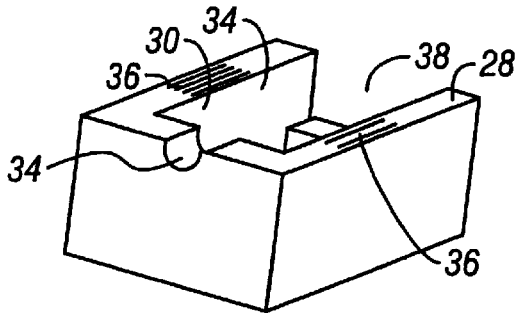
FIG. 4 is an isometric view of the base housing.
Figure 5A:
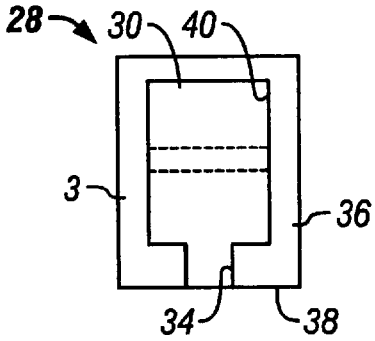
FIG. 5*a* is a top view of the base housing.
Figure 5B:
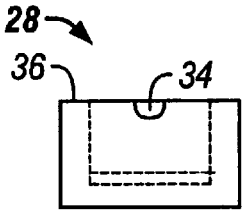
FIG. 5*b* is a front view of the base housing.
Figure 5C:
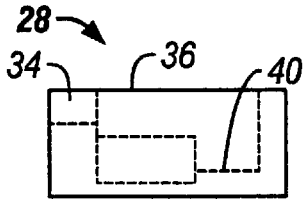
FIG. 5*c* is a side view of the base housing.
Figure 6:
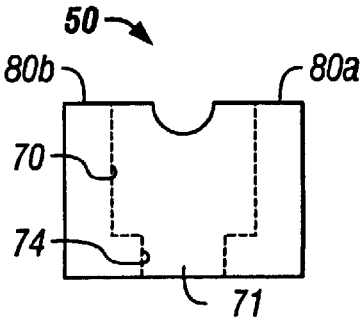
FIG. 6 is a front view of a housing member that is adapted to house the plunger.

As shown in FIGS. 3, 6, 7, 11, 12, 14, 15, 17, 18, 20, and 21, the aforementioned press 26 comprises a plunger 48 and a housing 50. As shown in FIG. 3, the plunger 48 comprises an engagement region 52 and an attachment region 54. The attachment region 54 is adapted to be mounted to a second arm 114 (FIG. 1). Located in the central portion of the plunger 48 is a shaft portion 56 that is adapted to mount the housing 50 which is shown in FIG. 6. As can be seen in FIG. 8, the engagement region 52 (FIG. 3) comprises an engagement member 58 that is adapted to house a plurality of terminating blades 60. The terminating blades 60 are adapted to engage individual twisted pair wires that are mounted into a receiving portion of a jack described further herein. The engagement member 58 further comprises cutting blades 60 that are adapted to shear the excess wire from the cable when the tool 20 engages a twisted pair cable to a jack.

Figure 7:
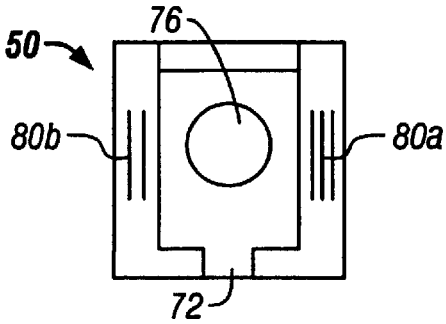
FIG. 7 is a top view of the housing member shown in FIG. 6.
Figure 8:
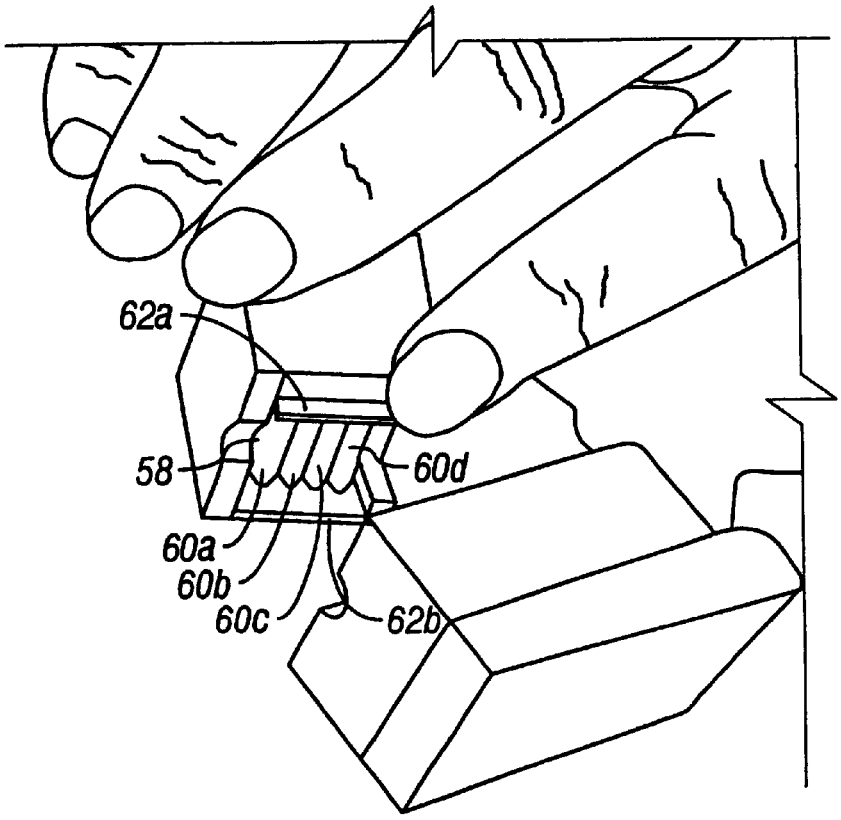
FIG. 8 is an isometric view showing the engagement member of the press where the upper housing is partially retracted.

As shown in FIGS. 6 and 7, the housing 50 is preferably a unitary member and comprises an inner surface 70 that is adapted to intimately engage the outer surface of the engagement member 58. A recessed region 72 is located in the forward region to allow the terminating cable to extend therethrough. A surface 74 defines a central opening 76 that is adapted to intimately engage the outer surface of the shaft portion 56 which is slidably extends therethrough. The surfaces 80*a*, 80*b* of the housing 50 has a frictionally engaging contour that is adapted to cooperate with the frictionally engaging surface 38 of the base housing 28 to hold the excess wire ends during the crimping process described further herein. As shown in FIG. 1, in the preferred form a spring member 80*c* biases the housing member 50 away from the second arm 114 so that housing member 58 extends into an operational position with the base housing 28.

As shown in FIG. 1, the handle lever portion 22 comprises a grasping section 100 and an operating section 102. The primary function of the handle lever portion 22 is to reposition the press 26 and the base housing 28 in the crimping process. In one form the handle lever portion comprises the first handle 104 and a second handle 106 that are pivotally connected at pivot point 108. The first handle 104 is further pivotally connected to a first arm 110 at pivot location 112 and the second handle 106 is pivotally connected to the second arm 114 at pivot location 116. The first and second arms 110 and 114 are further pivotally connected at pivot location 118 and the operating section 102 is defined as the portion of the first and second arms 110 and 114 left of the pivot location 118 as shown in FIG. 1. Thus, apparatus 20 operates with dual-pivot action or double action about the two spaced-apart pivot locations 108 and 118.

It can be appreciated that as the first and second handles 104 and 106 pivot towards one another, the operating section 102 of the first and second arms 110 and 114 move toward one another to an operative position as shown in FIG. 1. Of course, a number of arrangements of the handle portion 22 can be employed; however, there are particular advantages of having the pivot point 118 a longitudinal distance 120 from the mean engagement location 122 so the blades 60 engage the jack and the separate pairs of wires in a progressive fashion as the operative portions of the arms 110 and 114 move towards one another.

Figure 9:
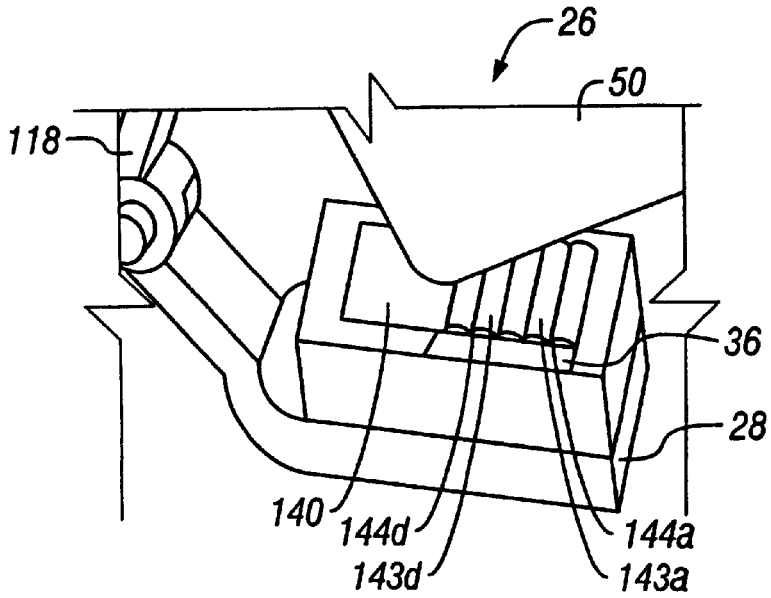
FIG. 9 is an isometric view of the terminating process where a jack and cable is mounted to the base housing.
Figure 10:
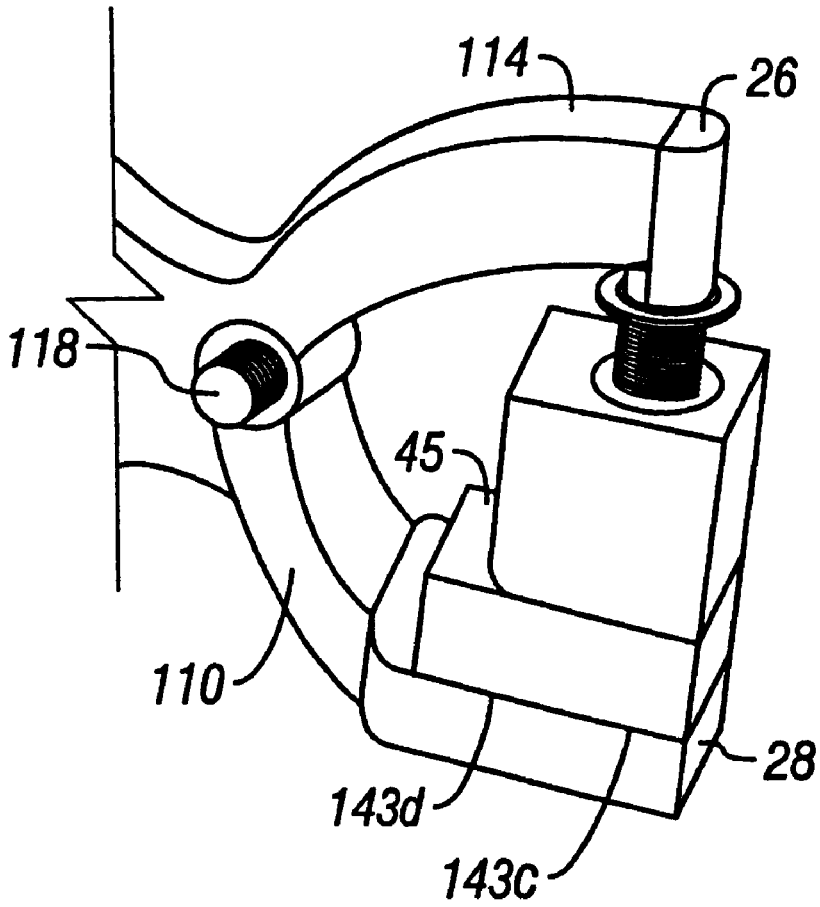
FIG. 10 is an isometric view showing the second phase of the terminating process.
Figure 11A:
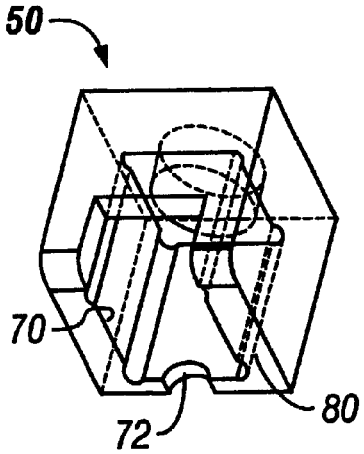
FIGS. 11A, 11B, 11C and 11D are, respectively, isometric, side, front, and top views of the upper housing of the present invention.
Figure 11B:
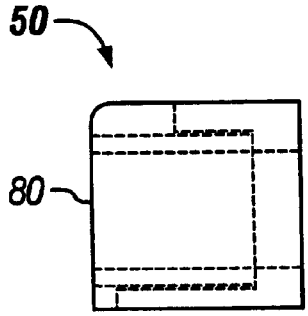
Figure 11C:
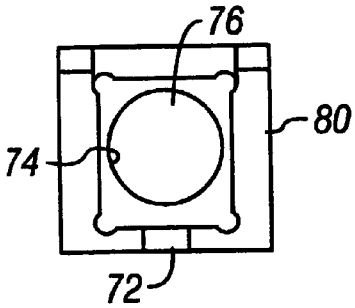
Figure 11D:
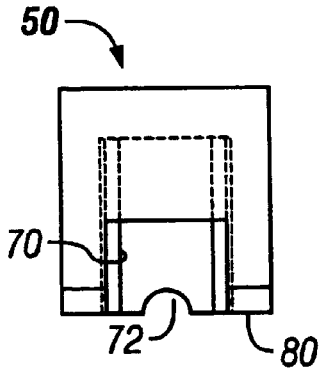
Figure 12A:
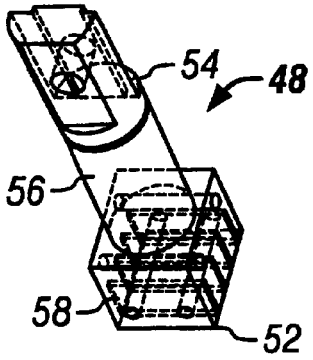
FIGS. 12A, 12B, 12C, and 12D are, respectively, isometric, front, side, and bottom views of a plunger of the tool of the present invention.
Figure 12B:
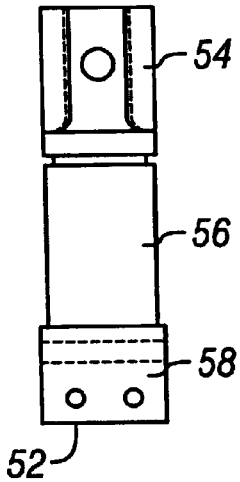
Figure 12C:
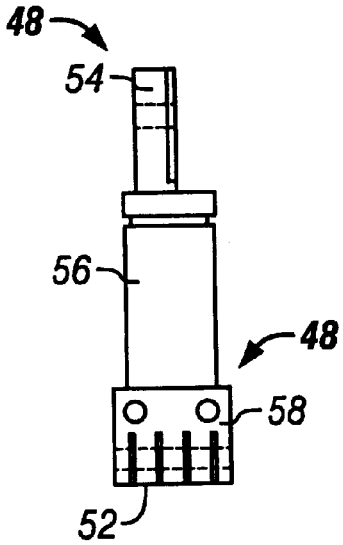
Figure 12D:
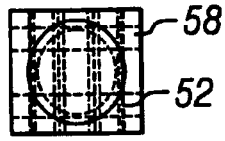
Figure 13A:
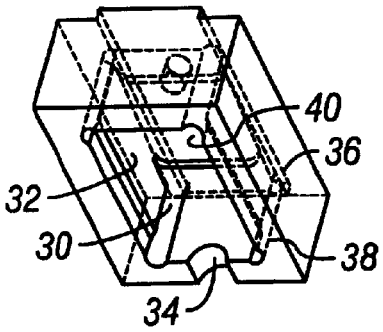
FIGS. 13A, 13B, 13C, and 13D are, respectively, isometric, side, top, and back views of a lower housing of the present invention.
Figure 13B:
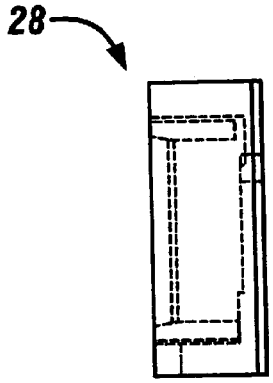
Figure 13C:
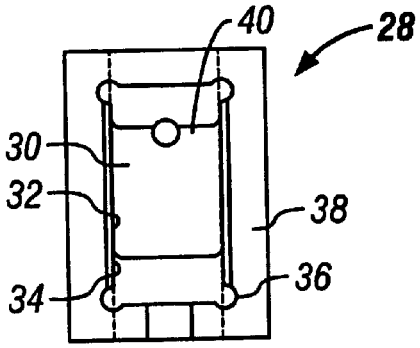
Figure 13D:
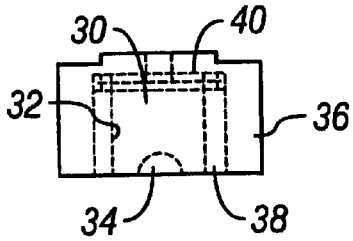
Figure 14A:
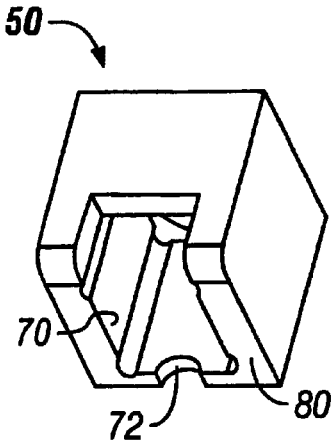
FIGS. 14A, 14B, 14C, and 14D are views similar to, respectively, FIGS. 11A–11D of a modified form of the upper housing.
Figure 14B:
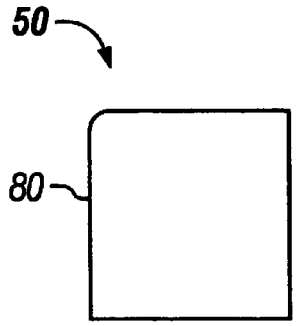
Figure 14C:
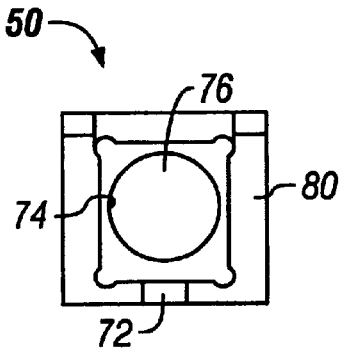
Figure 14D:
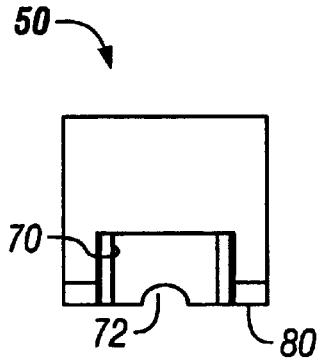
Figure 15A:
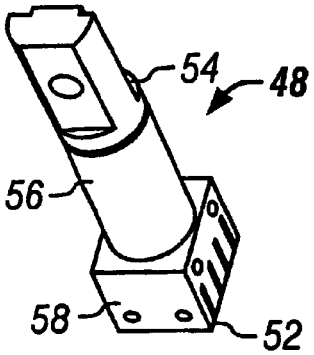
FIGS. 15A, 15B, 15C, and 15D are views similar to, respectively, FIGS. 12A–12D, showing a modified form of the plunger.
Figure 15B:
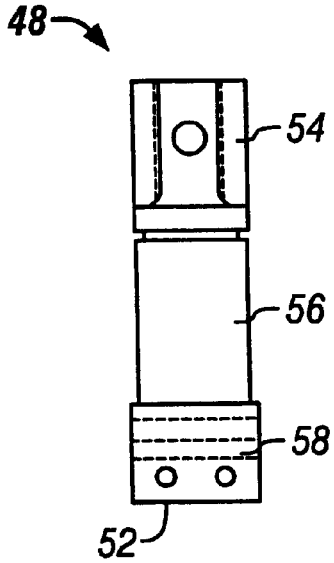
Figure 15C:
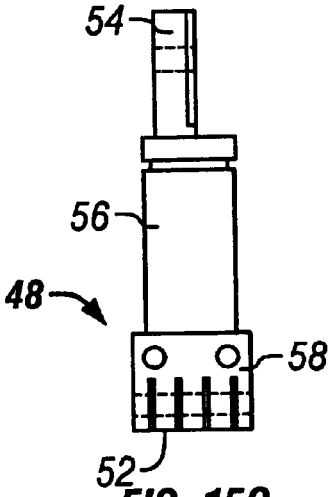
Figure 15D:
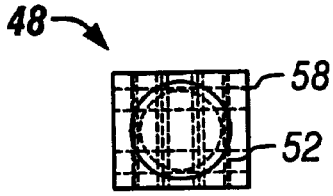
Figure 16A:
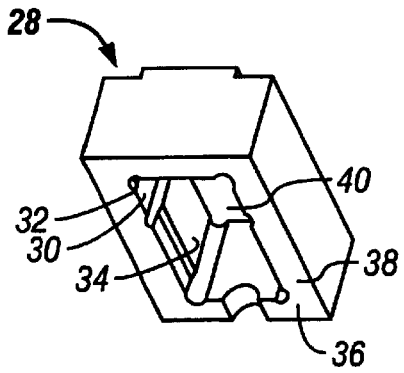
FIGS. 16A, 16B, 16C and 16D are similar to, respectively, FIGS. 13A–13D, showing a modified form of the lower housing.
Figure 16B:
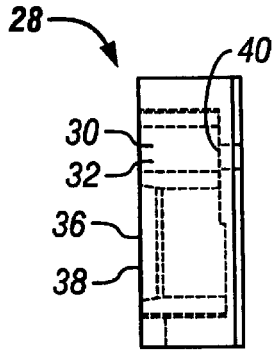
Figure 16C:
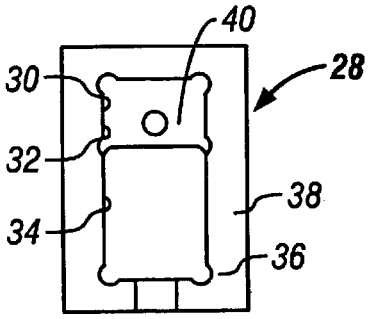
Figure 16D:
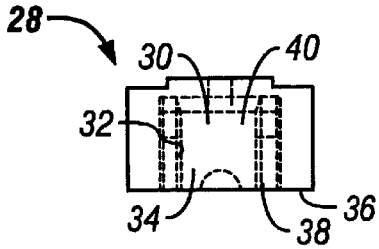
Figure 17A:
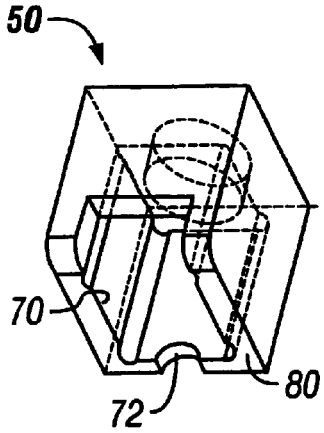
FIGS. 17A, 17B, 17C, and 17D are views similar to, respectively, FIGS. 11A–11D of a modified form of the upper housing.
Figure 17B:
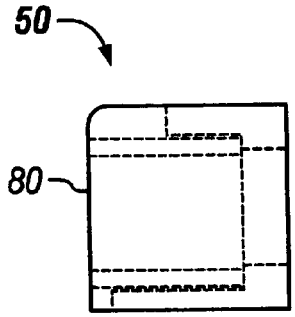
Figure 17C:
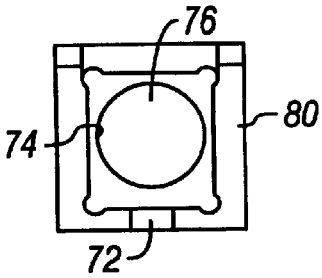
Figure 17D:
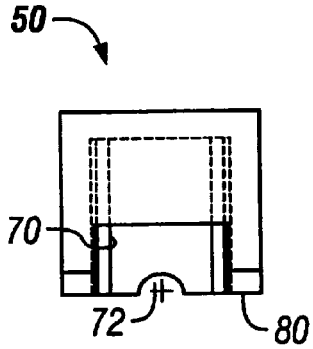
Figure 18A:
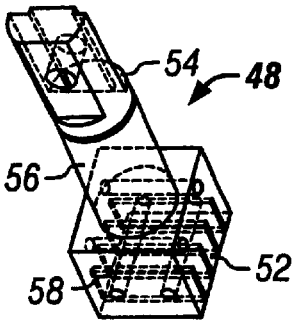
FIGS. 18A, 18B, 18C, and 18D are views similar to, respectively, FIGS. 12A–12D, showing a modified form of the plunger.
Figure 18B:
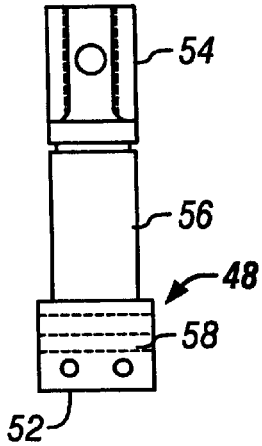
Figure 18C:
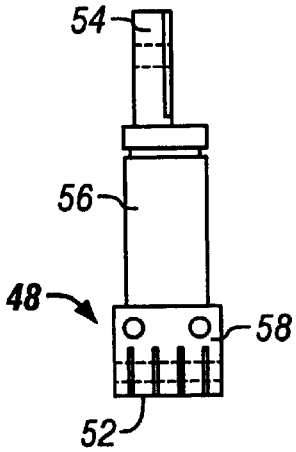
Figure 18D:
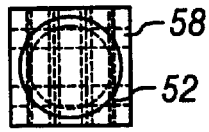
Figure 19A:
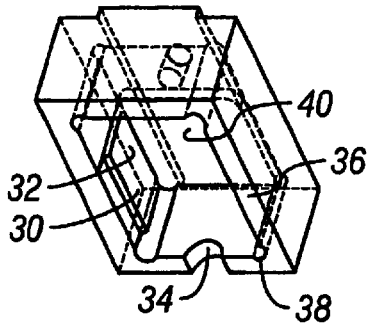
FIGS. 19A, 19B, 19C, and 19D are similar to, respectively, FIGS. 13A–13D, showing a modified form of the lower housing.
Figure 19B:
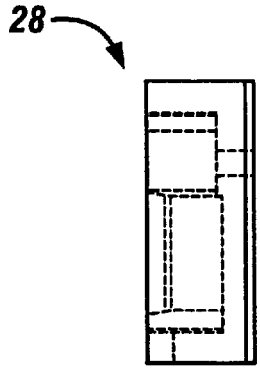
Figure 19C:
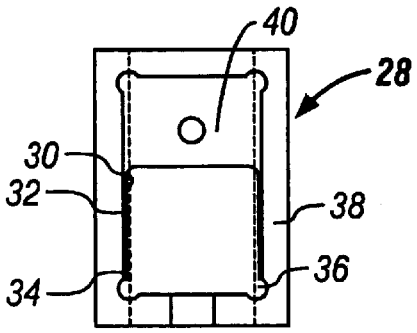
Figure 19D:
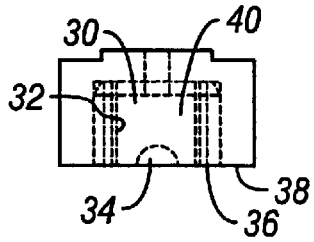
Figure 20A:
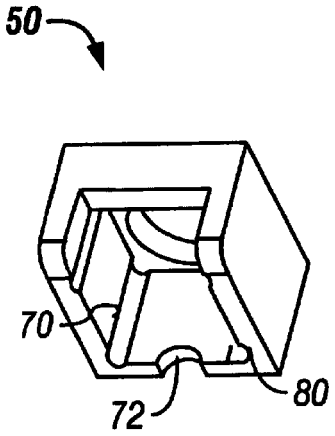
FIGS. 20A, 20B, 20C, and 20D are views similar to, respectively, FIGS. 11A–11D of a modified form of the upper housing.
Figure 20B:
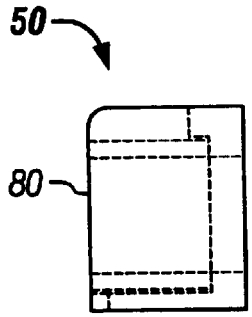
Figure 20C:
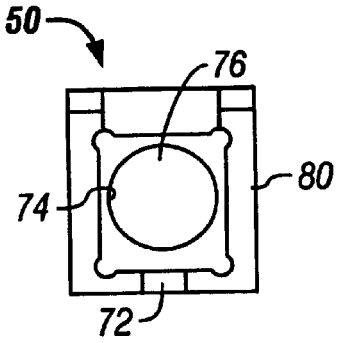
Figure 20D:
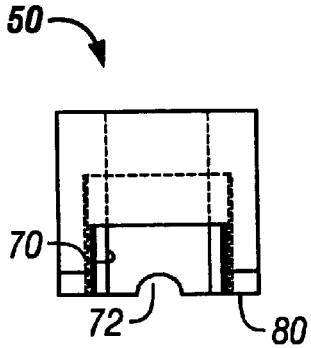
Figure 21A:
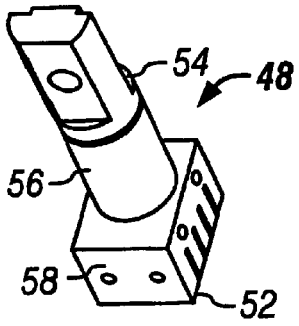
FIGS. 21A, 21B, 21C, and 21D are views similar to, respectively, FIGS. 12A–12D, showing a modified form of the plunger.
Figure 21B:
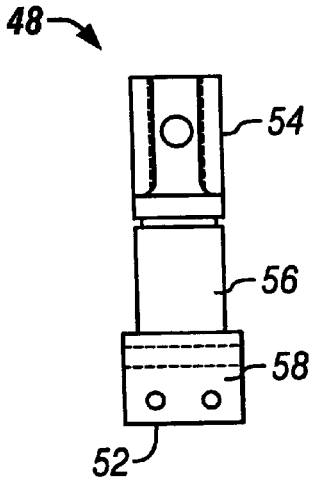
Figure 21C:
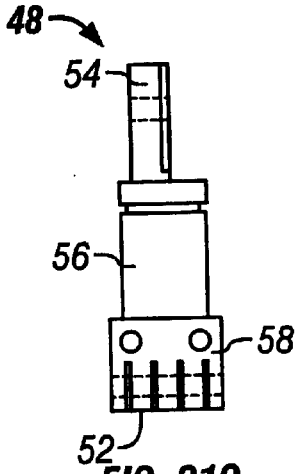
Figure 21D:
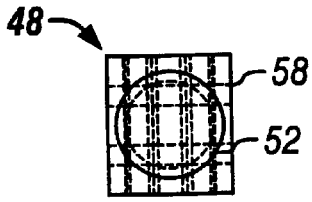
Figure 22A:
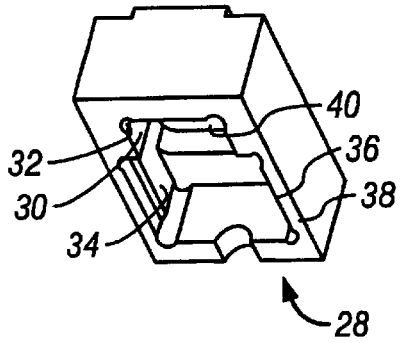
FIGS. 22A, 22B, 22C, and 22D are similar to, respectively, FIGS. 13A–13D, showing a modified form of the lower housing.
Figure 22B:
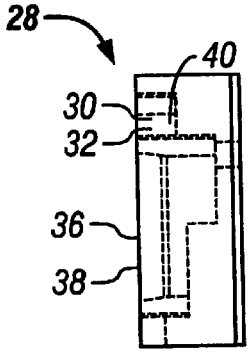
Figure 22C:
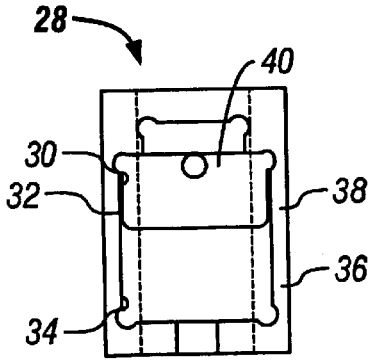
Figure 22D:
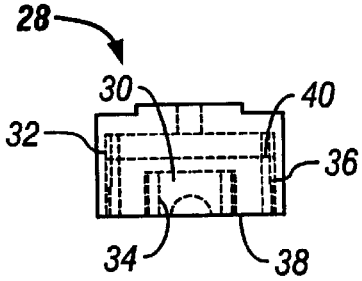

There will now be a detailed discussion of the crimping process with reference to FIGS. 9–10. As shown in FIG. 9, a jack 140 is positioned in the base housing 28 and the cable 142 comprises four twisted pair sets of wires where the wires 143 extends into receiving slots 144 of the jack 140. In general, the receiving slots comprise blades that are adapted to cut the insulation of the wires 143 and hence place the wires in communication with the communication port of the jack. The tool is particularly well suited and advantageous for terminating category 5 wire in R.J. 45 jacks.

After the jack is properly positioned, the terminating process begins where the handle lever portion 22 is operated and the housing 50 operatively engages the base housing 28 where the textured or knurled portions 36 and 80*a*, 80*b* engage the wires 143 and temporarily hold them therein between. After the housings 28 and 50 are engaged with one another, the plunger 48 extends through the central opening 74 of the housing 50 and the blades 60 of the engagement member 58 compress the wires 143 down within the receiving slots 144 of the jack 140. Further, the blades 60 cut the wires 143 and the excess wire in pieces are discarded (see FIG. 10).

It should be appreciated, that because the press 26 and the base housing 28 rotate in some manner about pivot location 118, the terminating blade 60*b* will engage the wire pair 143*d* before the remaining pairs of wires are engaged (i.e., in a progressive manner). See FIGS. 8 and 9. As the operating sections of the first and second arms 110 and 114 continue to pivot toward one another, the second terminating blade 60*c* will engage the corresponding wires 143*c* and mount the wire into the receiving slots 144*c* as well as shear the wire 143*c*, and the process continues until wire 143*a* is mounted and trimmed. It should be noted that the mounting and trimming do not necessarily occur simultaneously; however, the progression of the mounting occurs from wires 143*d* to 143*a*, and occurs progressively as the first and second arms 110 and 114 rotate. Likewise, the trimming of the wires 143*d* through 143*a* is executed in a progressive manner during the rotation of arms 110 and 114.

As a final step, the press 26 and the base housing 28 disengage from one another and the jack 140 is removed from the tool 20 with the cable 142 in communication with the electrical contacts of the jack 140.

While the invention is susceptible of various modifications and alternative forms, specific embodiments thereof have been shown by way of example in the drawings as described in detail. It should be understood, however, that it is not intended to limit the invention to the particular forms disclosed, but, on the contrary, the intention is to cover all modifications, equivalents and alternatives falling within the spirit and scope of the invention as expressed in the appended claims. It is desired that the embodiment described above may be considered in all respects as illustrative, not restrictive, reference being made to the appended claims to indicate the scope of the invention.

What is claimed is:

1. A tool for terminating wires to a jack, comprising:

a handle lever portion;

a crimp portion having a movable press and a movable base housing located opposite the press;

a pivot mechanism mounted between the handle lever portion and the crimp portion;

the base housing is adapted to support the jack such that the press pivots into engagement with the base housing and the jack to progressively terminate the wires; and the press comprises a plunger and a housing, and the plunger comprises an engagement region and an attachment region that is mounted to an arm of the crimp portion.

2. The tool of claim 1 wherein the pivot mechanism has two spaced-apart pivot points for providing double-action.

3. The tool of claim 1 wherein the base housing further comprises lateral regions with frictionally engaging surface portions that are adapted to clamp to ends of the wires.

4. The tool of claim 1 wherein the plunger has a shaft portion mounted to the housing.

5. The tool of claim 1 wherein the engagement region comprises an engagement member having a plurality of terminating blades for engaging individual twisted pairs of the wires that are mounted into a receiving portion of the jack.

6. The tool of claim 5 wherein the engagement member further comprises cutting blades that are adapted to shear excess wire from the wires when the tool engages a twisted pair cable to a jack.

7. The tool of claim 1 wherein the housing has textured surfaces that cooperate with a frictionally engaging surface of the base housing to hold excess wire during a crimping process.

8. A tool for terminating wires to a jack, comprising:

a handle lever portion having a first handle and a second handle that are pivotally connected at a main pivot point, the first handle is further pivotally connected to a first arm at a first pivot location, the second handle is pivotally connected to a second arm at a second pivot location, and the first and second arms are further pivotally connected at an auxiliary pivot point, such that the handle lever portion operates with dual-pivot action about the main and auxiliary pivot points;

a base housing mounted to the first arm;

a press mounted to the second arm;

the base housing is adapted to support the jack such that the press pivots into engagement with the base housing and the jack to progressively terminate the wires; and the press comprises a plunger and a housing, and the plunger has an engagement region, an attachment region that is mounted to the second arm, and a shaft portion mounted to the housing.

9. The tool of claim 8, wherein the terminating blades and the cutting blades are adapted to progressively engage the pairs of wires.

10. The tool of claim 7 wherein the base housing further comprises lateral regions with frictionally engaging surface portions that are adapted to clamp to ends of the wires.

11. The tool of claim 8 wherein the engagement region comprises an engagement member having a plurality of terminating blades for engaging individual twisted pairs of the wires that are mounted into a receiving portion of the jack.

12. The tool of claim 11 wherein the engagement member further comprises cutting blades that are adapted to shear excess wire from the wires when the tool engages a twisted pair cable to a jack.

13. The tool of claim 8 wherein the housing has textured surfaces that cooperate with a frictionally engaging surface of the base housing to hold excess wire during a crimping process.

* * * * *